US005707001A

United States Patent [19]

Mark et al.

[11] Patent Number: 5,707,001

[45] Date of Patent: Jan. 13, 1998

[54] SUSPENDED FILE FOLDERS

[75] Inventors: Wallace N. Mark; Thomas W. Deans, both of Hamilton, Canada

[73] Assignee: Canadian Environmental Office Products Inc., Hamilton, Canada

[21] Appl. No.: 647,659

[22] Filed: May 15, 1996

[51] Int. Cl.[6] ..... B65D 27/02

[52] U.S. Cl. ..... 229/67.2; 312/184

[58] Field of Search ..... 229/67.2; 312/184; 40/359

[56] References Cited

U.S. PATENT DOCUMENTS

| | | | |
|---|---|---|---|
| D. 248,484 | 7/1978 | Hedstrom et al. . | |
| D. 250,715 | 1/1979 | Hedstrom et al. . | |
| D. 268,348 | 3/1983 | Beleckis . | |
| D. 312,840 | 12/1990 | Price et al. . | |
| D. 317,018 | 5/1991 | Tarlow et al. . | |
| D. 322,284 | 12/1991 | Whaley et al. . | |
| 2,631,589 | 3/1953 | Zalkind . | |
| 3,263,688 | 8/1966 | Anders . | |
| 3,470,290 | 9/1969 | Poris et al. . | |
| 3,528,715 | 9/1970 | Williams, Jr. | 312/184 |
| 3,613,281 | 10/1971 | Lennartz . | |
| 3,863,828 | 2/1975 | King . | |
| 4,830,268 | 5/1989 | Pitts . | |
| 4,867,319 | 9/1989 | Arner et al. | 229/67.2 X |
| 5,163,606 | 11/1992 | Isserstedt . | |
| 5,261,636 | 11/1993 | Hawes et al. . | |
| 5,275,439 | 1/1994 | Hawes et al. . | |

FOREIGN PATENT DOCUMENTS

| | | | |
|---|---|---|---|
| 324531 | 5/1981 | Canada . | |
| 57178 | 12/1952 | France | 312/184 |
| 1166685 | 11/1958 | France | 312/184 |
| 75 34309 | 11/1975 | France . | |
| 2387798 | 12/1978 | France | 321/184 |

*Primary Examiner*—Jes F. Pascua
*Attorney, Agent, or Firm*—R. Craig Armstrong

[57] ABSTRACT

The suspended file folder is made entirely from thermoplastic material. The assembly uses a thermoplastic sheet folded along at least one score line to define a folder. The folder has integral suspension portions extending laterally from upper side edges, having generally U-shaped downwardly-opening notches therein to accommodate the suspension rails. Two thermoplastic support bars are permanently fused one to each wall of the folder along the upper edges thereof to provide the required degree of strength and rigidity. The support bars have generally U-shaped downwardly-opening notches therein, corresponding to and aligned with the notches in the suspension portions of the folders. The support bars preferably are provided with ribs to enhance rigidity and strength. Preferably, there are two of the score lines at the bottom of the folder, so that the folder is somewhat U-shaped rather than V-shaped. Additional score lines may be provided as well if desired, particularly to accommodate thicker files or more papers. The folders are preferably formed by co-extruding the sheets together with the support bars, in a continuous web. The folders are then completed by die-cutting to separate the folders from each other, and to simultaneously cut away a strip of material to leave behind the folder shape including the suspension portions and U-shaped notches. The invention thus includes a method of manufacturing the file folder assembly, as well as the folder assembly itself.

14 Claims, 4 Drawing Sheets

SUSPENDED FILE FOLDERS

BACKGROUND OF THE INVENTION

This invention relates to suspended file folders.

Suspended file folders are well known. The most common types are formed from a folded cardboard folder that is attached at its upper edges to metal support bars. The support bars project from either side of the folder to form hooks engageable with the suspension rails of a filing drawer.

While such folders have achieved considerable commercial success, they have a variety of disadvantages or weaknesses, including some or all of the following:

a. The support bars tend to be susceptible to being permanently bent or otherwise misshapen. Bent or misshapen bars alter the distance between the end hooks, potentially causing the file folders to fall away from the suspension rail. The bars typically are of metal of a thickness that causes them to bend easily and permanently when loaded with weight from files.

b. The metal bars glide poorly on the metal suspension rails. Thus in some versions, separate plastic inserts attached to the metal bars are employed.

c. The folders are subject to frequent crumpling or ripping, particularly at the medial fold which must bear both weight and impact from inserted files or papers, and also along the side edges.

d. At the top of the folder, both in designs where the cardboard has been folded over the support bars and attached to itself, and in designs where the metal bar and the cardboard are glued or otherwise fastened to each other, the cardboard tends to detach as a result of general wear, poor quality glue, insufficient glue, or poor manufacturing techniques.

e. Similarly, the metal bars tend to rip through the cardboard at the top of the folder, due to handling which cause the edges of the metal bar to cut through the cardboard.

f. Recycling of the folders is inefficient, since it requires separating the cardboard portion from the metal portion. The presence of adhesives may make recycling more difficult. In practice, the folders are therefore not often recycled, and instead they are discarded into the waste stream, which is obviously undesirable.

g. Manufacture of the folders is not as efficient as it would be if the step of securing the folder to the support bar could be avoided.

Not all suspended file folder have all of the above problems, and indeed some designs have attempted to address some or all of these problems. However, they are still not sufficiently durable or otherwise close to ideal, and there remains a need for improvement such as that provided by the present invention.

SUMMARY OF THE INVENTION

In view of the above, it is an object of the invention to provide a suspended file folder which avoids or reduces as many as possible of the above-mentioned problems.

The invention thus provides a file folder assembly which is made entirely from thermoplastic material. The assembly uses a thermoplastic sheet folded along at least one score line to define a folder. The folder has integral suspension portions extending laterally from upper side edges, having generally U-shaped downwardly-opening notches therein to accommodate the suspension rails. Two thermoplastic support bars are permanently fused one to each wall of the folder along the upper edges thereof to provide the required degree of strength and rigidity. The support bars have generally U-shaped downwardly-opening notches therein, corresponding to and aligned with the notches in the suspension portions of the folders. The support bars preferably are provided with ribs to enhance rigidity and strength.

Preferably, there are two of the score lines at the bottom of the folder, so that the folder is somewhat U-shaped rather than V-shaped. Additional score lines may be provided as well if desired, particularly to accommodate thicker files or more papers.

The folders are preferably formed by co-extruding the sheet together with the support bars, in a continuous web. The folders are then completed by die-cutting to separate the folders from each other, and to leave behind the folder shape including the suspension portions and U-shaped notches. The invention thus includes a method of manufacturing the file folder assembly, as well as the folder assembly itself.

The folders of the invention represent a significant improvement over the metal/folded cardboard folders that are currently used commercially. The folders of the invention, especially when formed from a thermoplastic material are essentially not susceptible to such tearing. The thermoplastic bar is not susceptible to permanent bending or to rusting which can discolor the body of the folder. The folder of the invention are also more resistant to wear, resistant to stains and humidity and will keep its aesthetic qualities for a longer period of time. As the folders of the invention may be made from one thermoplastic polymer family, such folders are conducive to recycling processes.

BRIEF DESCRIPTION OF THE DRAWINGS

The invention will be described with reference to the accompanying drawings of the preferred embodiments by way of example. In those drawings.

DETAILED DESCRIPTION OF THE PREFERRED EMBODIMENTS

Figure 1:
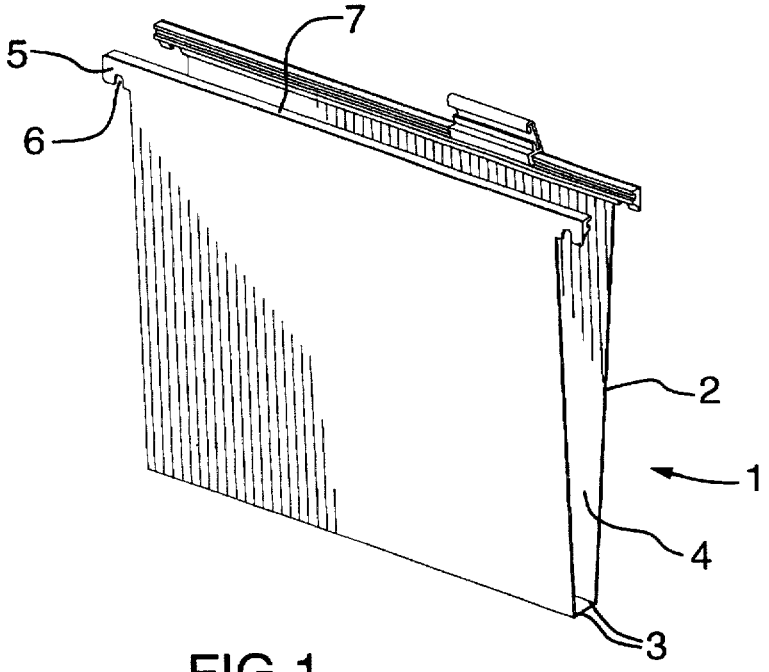
FIG. 1 is a perspective view of the folder assembly.
Figure 2:
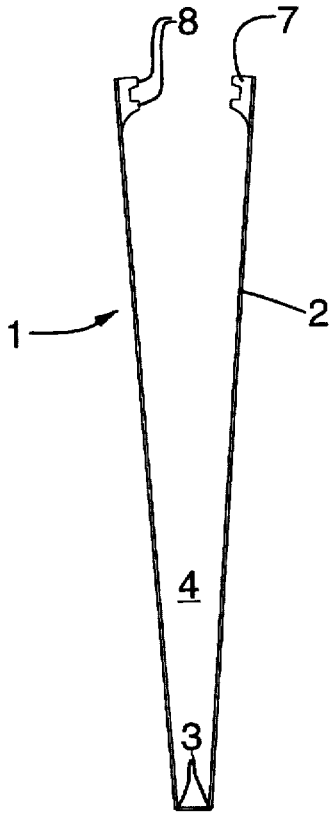
FIG. 2 is an end view of the folder assembly.
Figure 3:
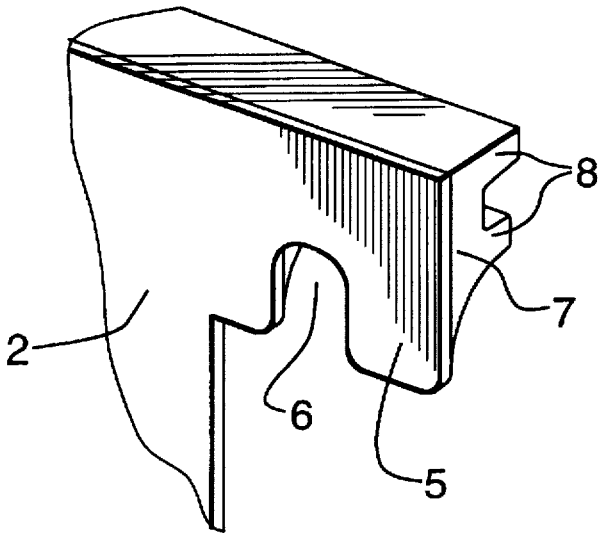
FIG. 3 is a perspective view of the outside of the suspension portion of the folder.
Figure 4:
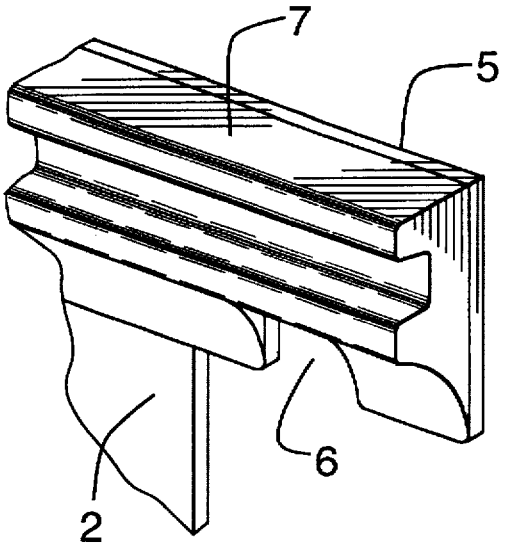
FIG. 4 is a perspective view of the inside of the suspension portion of the folder.

FIG. 1 shows the file folder assembly 1, which is made entirely from thermoplastic material. The assembly uses a thermoplastic sheet 2 folded along one or more score lines 3 to define a folder 4. The folder has integral suspension portions 5 extending laterally from upper side edges, having generally U-shaped downwardly-opening notches 6 therein to accommodate conventional suspension rails (not shown). Two thermoplastic support bars 7 are permanently fused one to each wall of the folder along the upper edges thereof to provide the required degree of strength and rigidity.

Figure 5:
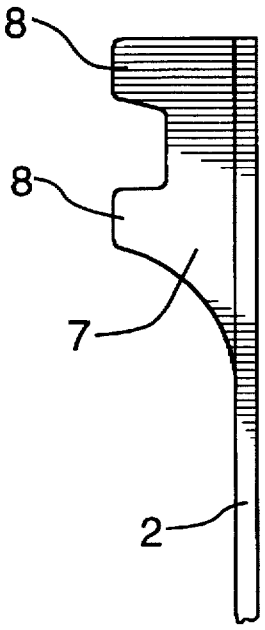
FIG. 5 is a cross-section showing the preferred profile for the support bars.
Figure 6:
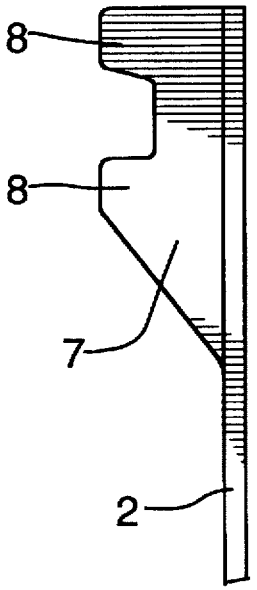
FIG. 6 is a cross-section showing one alternative profile for the support bars.
Figure 7:
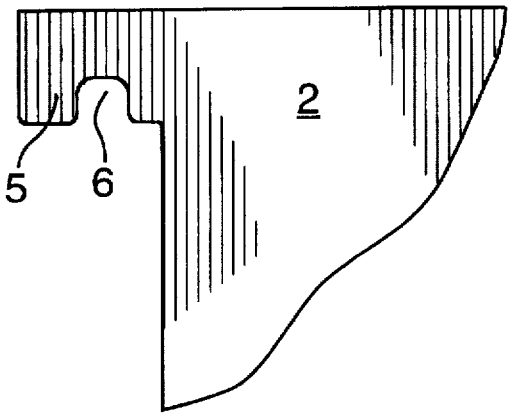
FIG. 7 is an elevation view of the outside of the suspension portion of the folder.
Figure 8:
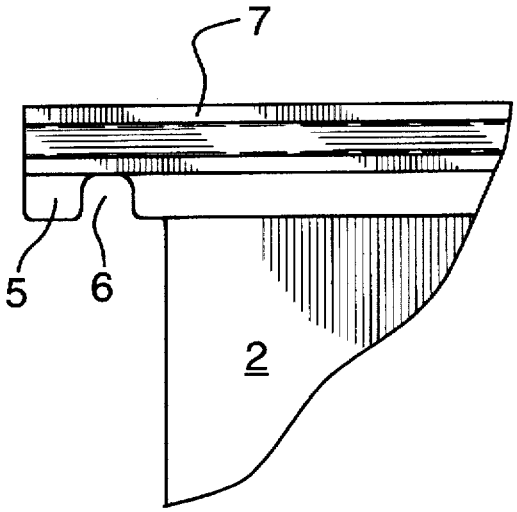
FIG. 8 is an elevation view of the inside of the suspension portion of the folder.

The support bars preferably are on the inside of the folder, but could be on the outside. They have generally U-shaped downwardly-opening notches therein, corresponding to and aligned with the notches in the suspension portions of the folders. The support bars preferably are provided with ribs 8 to enhance rigidity and strength. The U-shaped notches 6 preferably stop below the lowermost rib, to provide optimum load-being capability. As seen best in FIGS. 5 and 6, the lower portion of the support bars preferably is curved (FIG. 5) or straight-tapered (FIG. 6), to become flush with the sheet 2, to ensure that files or papers can be removed without catching on the support bars.

Preferably, there are two of the score lines 3 at the bottom of the folder, so that the folder is somewhat U-shaped rather than V-shaped, to provide greater wear resistance by reducing the angle at each score. Additional score lines may be provided as well if desired, particularly to accommodate thicker files or more papers.

Figure 9:
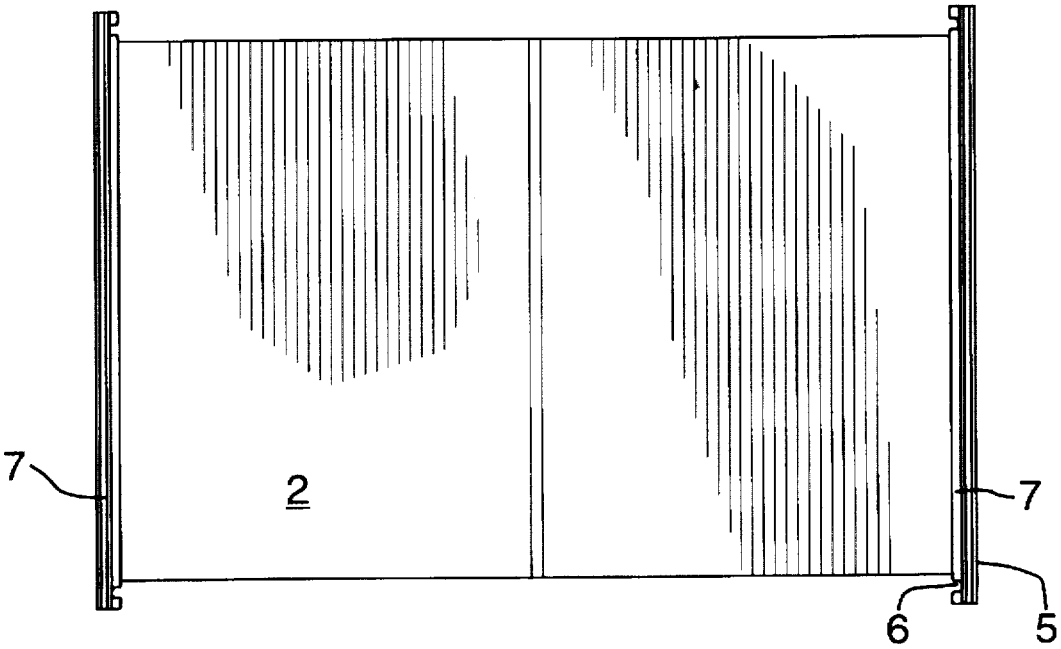
FIG. 9 is a plan view of the folder assembly, laid open.

The folders are preferably formed by co-extruding the sheet together with the support bars, in a continuous web. The folders are then completed by die-cutting to separate the folders from each other, and to leave behind the folder shape shown in FIG. 9, i.e. including the suspension portions and U-shaped notches. The invention thus includes a method of manufacturing the file folder assembly, as well as the folder assembly itself.

The material used to form the file folder is a thermoplastic polymer. It is preferred that the thermoplastic polymer be a melt-formable polymer, for ease of fabrication e.g. by melt extrusion of the polymer in a sheet. Excess polymer can also be recycled and re-extruded into a sheet.

The polymer in the sheet used to form the folder should have substantial stiffness, but still be sufficiently flexible to permit insertion of files into the folder. Sufficient stiffness is required at the top of the folder i.e. in the area used to suspend the file folders, referred to herein as upper edges having integral projecting end portions. The polymer used to form the support bars, in particular, should have properties so as to provide sufficient stiffness and strength for the support bars to be load bearing i.e. be substantially rigid but still have some flexibility. It is to be understood that this may be accomplished by selection of the thermoplastic material, but addition of reinforcing agents to a thermoplastic material similar to that used for the sheet is likely to be more conducive and amenable to recycling. In addition, the polymer needs to be capable of forming folds. The folds need to have significant wear resistance and strength for continued use of the folder.

For thermoplastic materials, the thickness of the sheet used to form the body of the folder preferably should be at least 5 mils (0.005 inches), and preferably 10–20 mils, 12–15 mils being the likely optimum. However, the thickness will depend on the particular thermoplastic polymer selected, and the strength and stiffness properties of that thermoplastic material, as well as the size of the folder being formed. The thermoplastic sheet used to form the folder will be preferably of uniform thickness.

The sheet and support bars may be formed from the same thermoplastic material, which facilitates recycling, but the polymer used to form the support bars may contain reinforcing agents e.g. conventional fillers such as talc, mica, glass, etc.. A combination of processes may be used e.g. profiled extrusion and adhesives. The sheet and support bars may be formed by coextrusion, especially using polymers that are amenable to recycling processes.

In view of the above, the preferred thermoplastic materials are polypropylene for the folder 4, and filled polypropylene for the support bars 7.

As seen in FIGS. 10–13, indexing tabs 9 can be readily adapted to mount on the folder. The ribs 8 provide anchoring means for the indexing tabs, and a track for the tabs to slide along. The tabs can thus be attached and positioned easily.

Figures 10, 11, 12, 13:
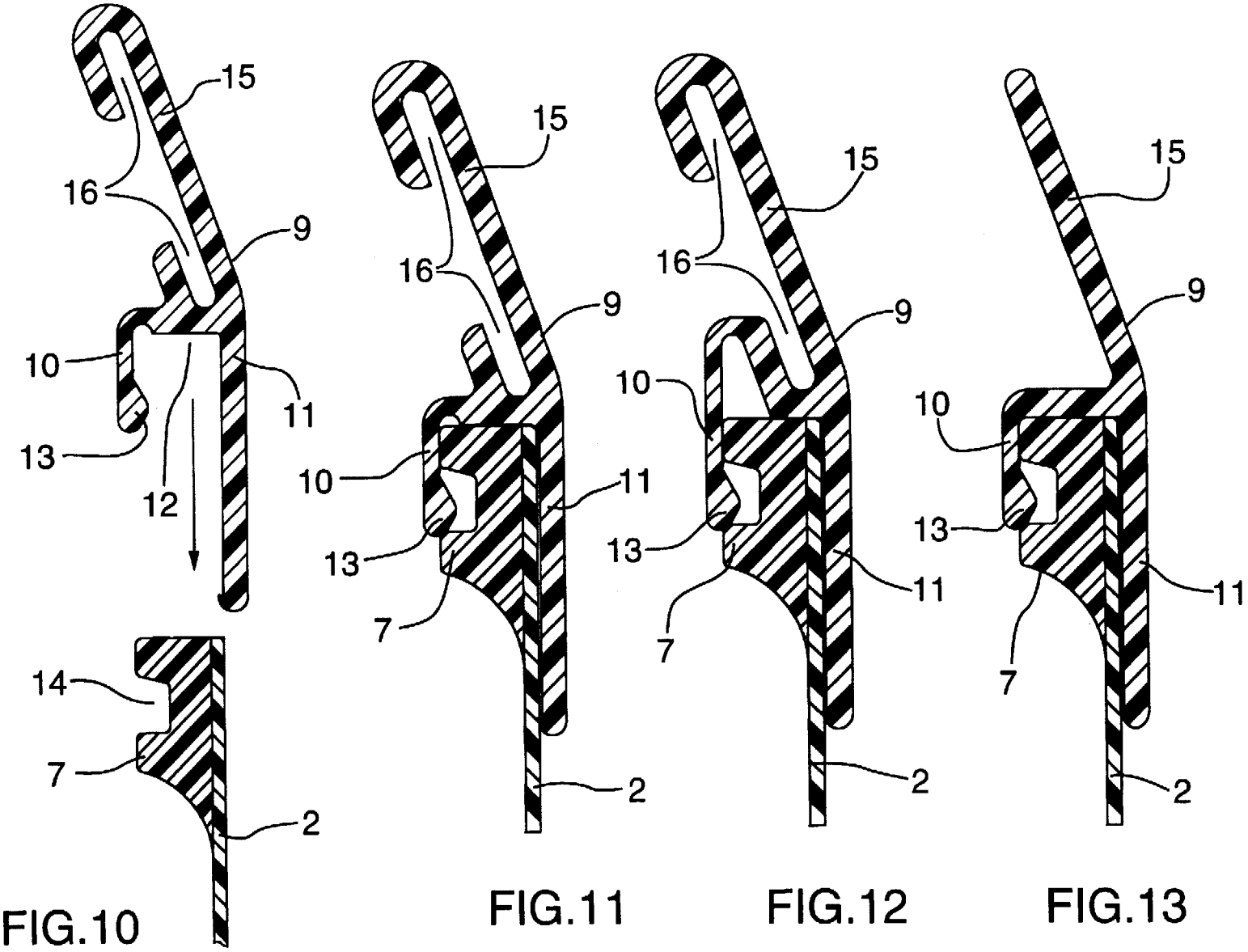
FIG. 10 is a cross-section showing an index tab which is mountable on the folder assembly.
FIG. 11 is a cross-section showing the index tab mounted on the folder assembly.
FIG. 12 is a cross-section showing an alternative configuration of index tab mounted on the folder assembly.
FIG. 13 is a cross-section showing another alternative configuration of index tab mounted on the folder assembly.

The indexing tab shown in FIGS. 10 and 11 has an inside wall 10 and an outside wall 11 defining a U-shaped opening 12 between them. The inside wall has a bulbous end portion 13, which locates in the channel or track 14 between the ribs 7. The upper indexing portion of the tab has a face portion 15, and the embodiments shown in FIGS. 11 and 12 have a label-carrying slot 16 defined behind the face portion. The FIG. 13 version is intended simply to have an adhesive label attached to the face portion, which FIGS. 11 and 12 have transparent face portions to see a label carried in the slot.

It will be appreciated that many variations on the invention will be obvious to those who are knowledgeable in the field. Such obvious variations are considered to be within the scope of the invention, whether or not expressly described above.

I claim:

1. A file folder assembly for suspension in a filing unit with two spaced-apart suspension rails, said file folder assembly comprising:

a sheet of thermoplastic polymer folded along at least one medial line to define a folder having opposing walls extending upwardly from said at least one medial line, each wall having an upper edge and two sides, said folder having integral suspension portions extending laterally beyond said side edges adjacent said upper edges, said suspension portions having notches configured to accommodate said suspension rails; and two thermoplastic polymer support bars, permanently fused one to each of said walls adjacent the upper edges thereof, inside said folder, said support bars having notches therein, corresponding to and aligned with said notches in said suspension portions of said folders, at least a portion of the cross-section of said support bars being substantially greater in thickness than said sheet of thermoplastic polymer, said support bars each having a tapered lower portion which tapers downwardly from said substantially greater thickness to substantially zero thickness flush with said sheet, thereby reducing any tendency for any papers in said file folder to catch on said support bars during removal from said folder.

2. A file folder assembly as recited in claim 1, in which there are at least two said medial lines spaced slightly apart from each other so as to provide a generally U-shaped folder.

3. A file folder assembly as recited in claim 2, in which said folder and said support bars are of polypropylene.

4. A file folder assembly as recited in claim 2, in which said support bars are provided with at least one rib extending therealong and projecting slightly therefrom, to provide additional strength and rigidity.

5. A file folder assembly as recited in claim 4, in which said folder and said support bars are of polypropylene.

6. A file folder assembly as recited in claim 1, in which said support bars are provided with spaced-apart upper and lower ribs extending therealong and projecting slightly therefrom, to provide additional strength and rigidity.

7. A file folder assembly as recited in claim 6, in which said folder and said support bars are of polypropylene.

8. A file folder assembly as recited in claim 6, further comprising at least one indexing tab mountable on said folder, each said indexing tab having an inside wall and an outside wall defining a U-shaped opening between them, said U-shaped opening being positionable over one of said support bars, and said inside wall having a bulbous end portion configured to locate between said upper and lower ribs, each said indexing tab further having an upper indexing portion extending upwardly above said inside and outside walls and having a portion for carrying labelling indicia.

9. A file folder assembly as recited in claim 8, in which said folder and said support bars are of polypropylene.

10. A file folder assembly as recited in claim 1, in which there are at least two said medial lines spaced slightly apart from each other so as to provide a generally U-shaped folder, and in which said support bars are provided with spaced-apart upper and lower ribs extending therealong and projecting slightly therefrom, to provide additional strength and rigidity.

11. A file folder assembly as recited in claim 10, in which said folder and said support bars are of polypropylene.

12. A file folder assembly as recited in claim 1, in which said folder and said support bars are of polypropylene.

13. A file folder assembly as recited in claim 1, in which said support bars are provided with at least one rib extending therealong and projecting slightly therefrom, to provide additional strength and rigidity.

14. A file folder assembly as recited in claim 13, in which said folder and said support bars are of polypropylene.

* * * * *